US005799736A

United States Patent [19]

Waldron

[11] Patent Number: 5,799,736

[45] Date of Patent: Sep. 1, 1998

[54] DIRT DISTRIBUTION METHOD

[75] Inventor: Curtis R. Waldron, Okeechobee, Fla.

[73] Assignee: R&R Enterprises Inc., Okeechobee, Fla.

[21] Appl. No.: 824,131

[22] Filed: Mar. 26, 1997

Related U.S. Application Data

[63] Continuation-in-part of Ser. No. 320,528, Oct. 11, 1994, Pat. No. 5,695,013.

[51] Int. Cl.[6] ..... A01B 49/02

[52] U.S. Cl. ..... 172/784; 172/67

[58] Field of Search ..... 37/380, 381, 465, 37/420; 172/33, 63, 67, 78, 784, 785

[56] References Cited

U.S. PATENT DOCUMENTS

| | | | |
|---|---|---|---|
| 2,875,838 | 3/1959 | McLarty | 172/784 X |
| 3,207,230 | 9/1965 | Raussendorf | 172/67 |
| 3,693,722 | 9/1972 | Brown | 172/785 X |
| 3,744,568 | 7/1973 | Beyers et al. | 172/785 X |
| 3,804,178 | 4/1974 | West | 172/784 X |

*Primary Examiner*—Michael J. Carone
*Assistant Examiner*—Robert Pezzuto
*Attorney, Agent, or Firm*—Carroll F. Palmer

[57] ABSTRACT

Highway and road maintenance costs and time are greatly reduced by an improved method of removing the typical mound of earth that accumulates along the edges of the roadway by providing an earth moving blade defined by a lengthwise bottom edge, a forward side edge, a rearward side edge and a front face, providing at the rearward side edge of the blade a dirt distribution device that includes a motor driven dirt sling unit, positioning the blade diagonally across the mound with its bottom edge penetrating the mound to slightly above the top surface of the road, moving the blade forward to move the portion of mound immediately in front of the blade across its face toward its rearward side edge, and rotating the dirt sling unit while allowing the earth ribbon to contact the sling unit thereby to disintegrate the ribbon into small pieces of earth that are thrown away from the rearward side edge of the blade.

3 Claims, 5 Drawing Sheets

16
30
2
26
18
85
102
108
104
106
110
28

16
100A
98
30A
24
56
96
18

16
99
98
38
100
30
80
24
18
96
64
60
40
54A
20
44
56
97
62
22
78
58
32
104
86
26
84
48
54B
88
50
52
54C
46
36

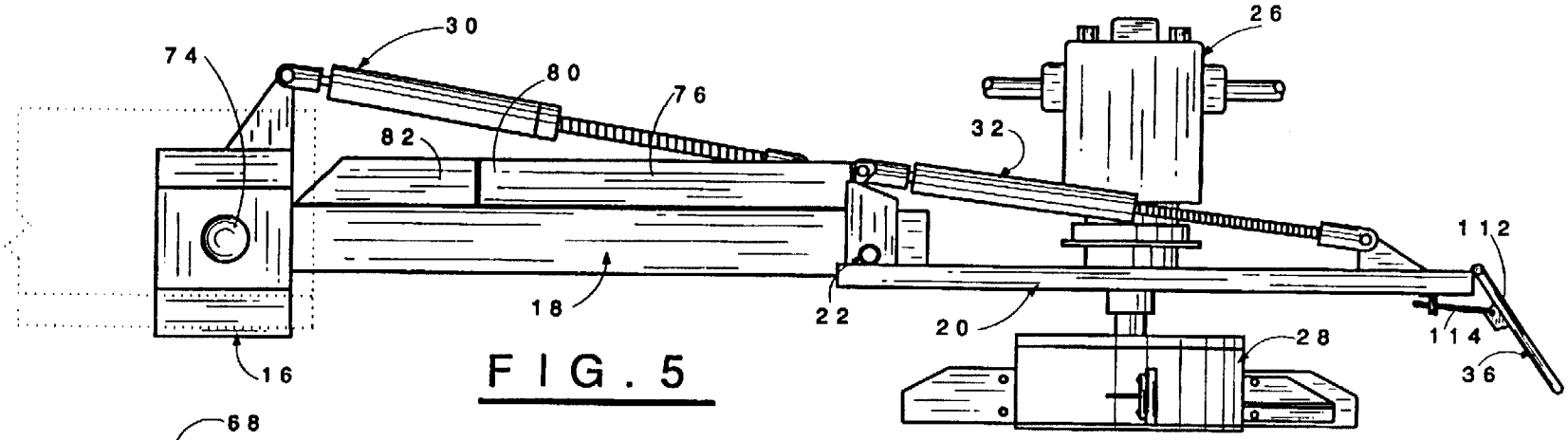
FIG. 5
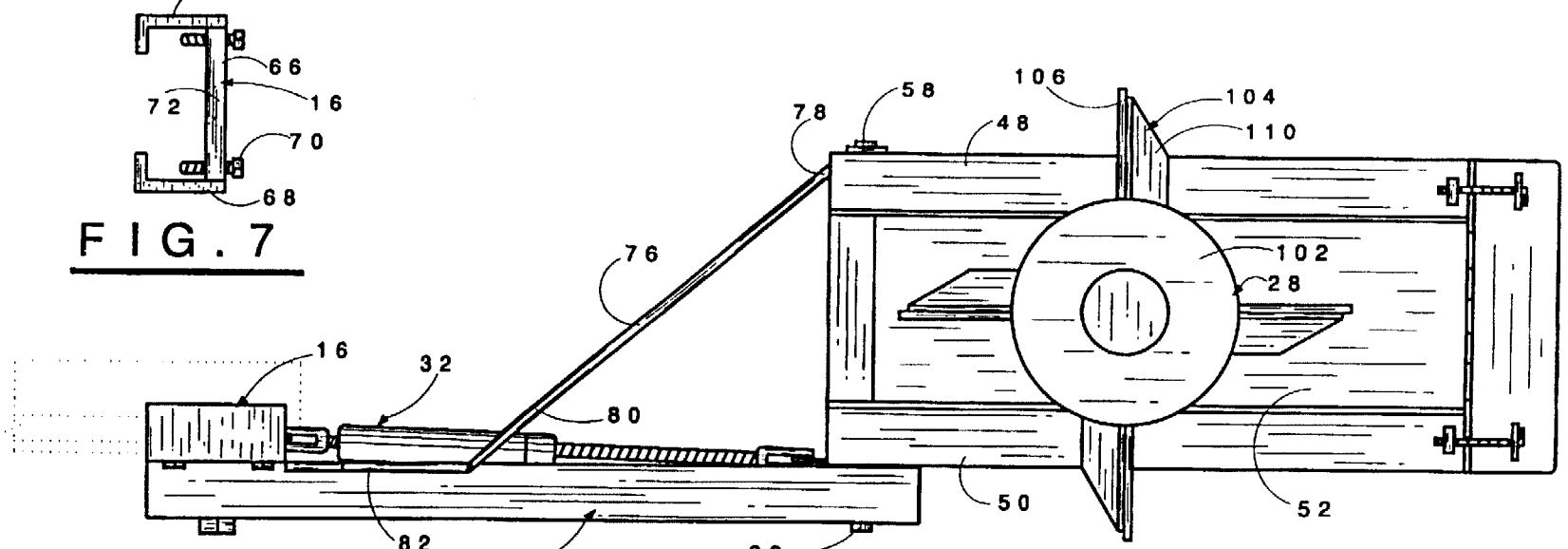
FIG. 6
FIG. 7

DIRT DISTRIBUTION METHOD

REFERENCE TO RELATED APPLICATION

This application is a continuation-in-part of application Ser. No. 08/320,528, filed Oct. 11, 1994, now U.S. Pat. No. 5,695,013.

BACKGROUND OF THE INVENTION

1. Field of the Invention

This application relates broadly to new earth moving devices and methods. More particularly, it concerns a unique method for removing mounds of earth paralleling a roadway or similar longitudinal portion of terrain and simultaneously distributing the resulting dirt over an extended area by means of a unique attachment to blade-type earth moving machines.

2. Description of the Prior Art

Numerous motor driven machines comprising a generally horizontal blade exist for moving earth, e.g., dirt, gravel, sand, etc. The present invention concerns an attachment for this class of earth moving equipment to expand the utility thereof and a new method using such equipment.

Blade-type earth moving machines are typically used to move a finite mass of earth from one location to another in a repetitive manner. Depending upon the skill of the operator, such equipment may be manipulated to distribute (spread) earth to a limited extent in addition to simply moving an earth mass from place to place. Attachments for such equipment have been devised to expand the distribution area that may be covered in the operation of such machines, e.g., see U.S. Pat. No. 3,148,466; 3,543,861 and 3,804,178. In a related way, distribution attachments have been devised for snow ploughs of the blade type, e.g., see U.S. Pat. No. 1,466,187 and 2,241,252.

The present invention provides a unique method for removing mounds of earth paralleling a roadway or similar longitudinal portion of terrain and simultaneously distributing the resulting dirt over an extended area by means of a unique attachment to blade-type earth moving machines during their operation.

OBJECTS

A principal object of the invention is the provision of a new method for removing mounds of earth paralleling a roadway or similar longitudinal portion of terrain and simultaneously distributing the resulting dirt over an extended area.

Another object is the provision of an improved type of attachment for blade-type earth moving machines for use in carrying out the new method of the invention.

A further object is the provision of an improved type of attachment for blade-type earth moving machines capable of slinging dirt emerging at the end of the blade carried thereby onto areas adjacent the line of travel of the blade-type earth moving machines.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in part in accordance with the invention by the provision of unique dirt distribution devices for attachment to the earth moving blade of an earth moving machine that basically comprise (a) clamp means for attachment of the device to an end of the earth moving blade, (b) a platform, (c) pivot means for the platform, (d) motor means carried upon the platform and (e) dirt sling means rotatably carried by the motor means.

The motor means advantageously comprises a hydraulic motor including a drive shaft upon which the dirt sling means is carried for rotation in a plane below the platform.

In the typical use of an earth moving machine of the invention, as the machine travels along and its blade scrapes a ribbon of dirt from the earth surface, such ribbon typically travels along the blade toward a discharge end and will be deposited closely adjacent the line of travel of the earth moving blade as large clumps of earth. With the new device of the invention attached to such an earth moving machine, the dirt ribbon as it discharges from the end of the blade will be disintegrated into small particles and slung over an extended area considerably removed from the path of the earth moving machine. By manipulation of the dirt distribution device, the area of land and its distance from the machine travel path may be controlled.

The objects are additionally accomplished in accordance with the invention by the provision of a new method of removing an elongated mound of earth, defined by a longitudinal axis bordering the longitudinal edge of an road having a top surface above which said mound projects, without need to truck away quantities of accumulated removed earth. Such new dirt distribution method comprises the steps of (1) providing upon an earth moving machine an earth moving blade defined by a lengthwise bottom edge, a forward side edge, a rearward side edge and a front face upstanding from the lower edge between the forward and rearward side edges, (2) providing at the rearward side edge of the blade a dirt distribution device that comprises dirt sling means rotatably driven by motor means, (3) positioning the blade diagonally across the longitudinal axis with the bottom edge penetrating the mound to slightly above the top surface of the road, (4) moving the blade forward along the longitudinal axis thereby to move the portion of the mound immediately forward of the front face as a ribbon of the earth above the lower edge and across the face toward the rearward side edge, and (5) rotating the dirt sling means while allowing the ribbon of the earth to contact the sling means thereby to disintegrate the ribbon into small pieces of earth that are thrown away from the rearward side edge.

In a first embodiment, wherein the top surface of the road is macadam or like hard surface material, the rearward side edge of the blade is on the side of the mound opposite to the road and the small pieces of earth are thrown away from the road.

In a second embodiment, wherein the top surface of the road is dirt, shale or like loose surface material, the rearward side edge of the blade is on the same side of the mound as the road and the small pieces of earth are thrown onto the road.

BRIEF DESCRIPTION OF THE DRAWINGS

A more complete understanding of the invention can be obtained by reference to the accompanying drawings in which generic parts of the illustrated matter are indicated by arrowhead lines associated with the designation numerals while specific parts are indicated with plain lines associated with the numerals and wherein:

FIG. 5 is a rear lateral view of the first embodiment of the dirt distribution device of the invention.

FIG. 6 is a bottom view of the first embodiment of the dirt distribution device of the invention.

FIG. 7 is a sectional side view of the clamp means for the dirt distribution device.

DESCRIPTION OF THE PREFERRED EMBODIMENTS

Figure 1:
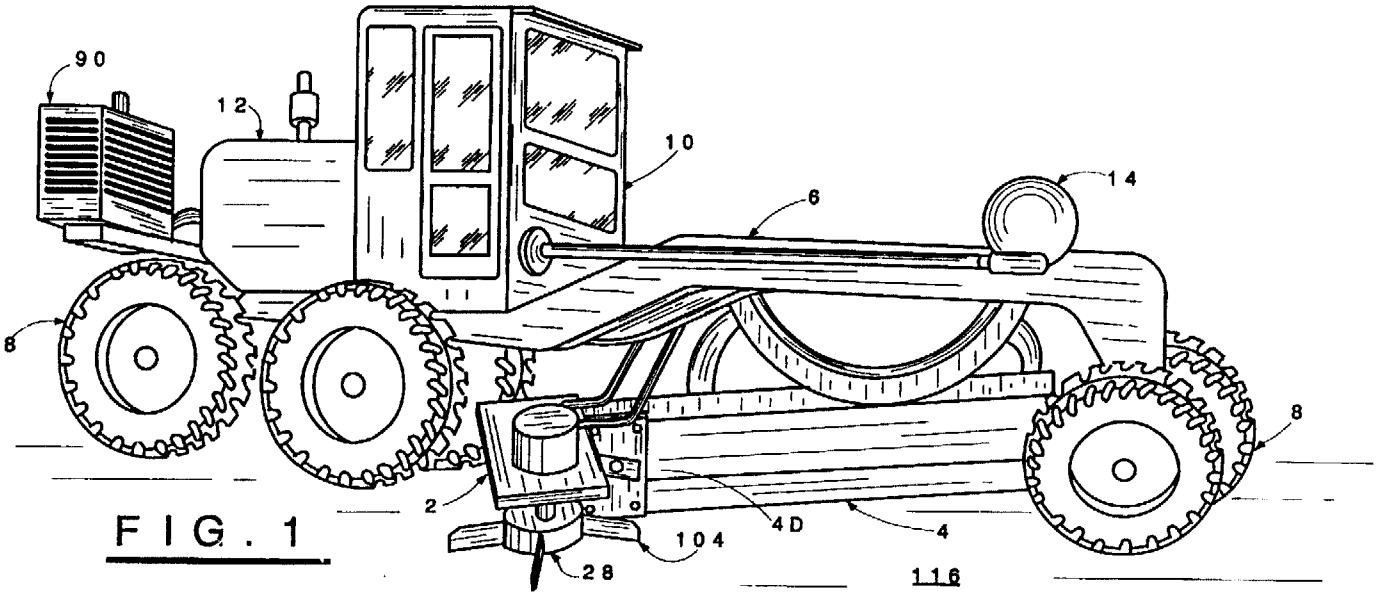
FIG. 1 is an isometric view of a bulldozer/grader machine equipped with a dirt distributing device of the invention.
Figure 2:
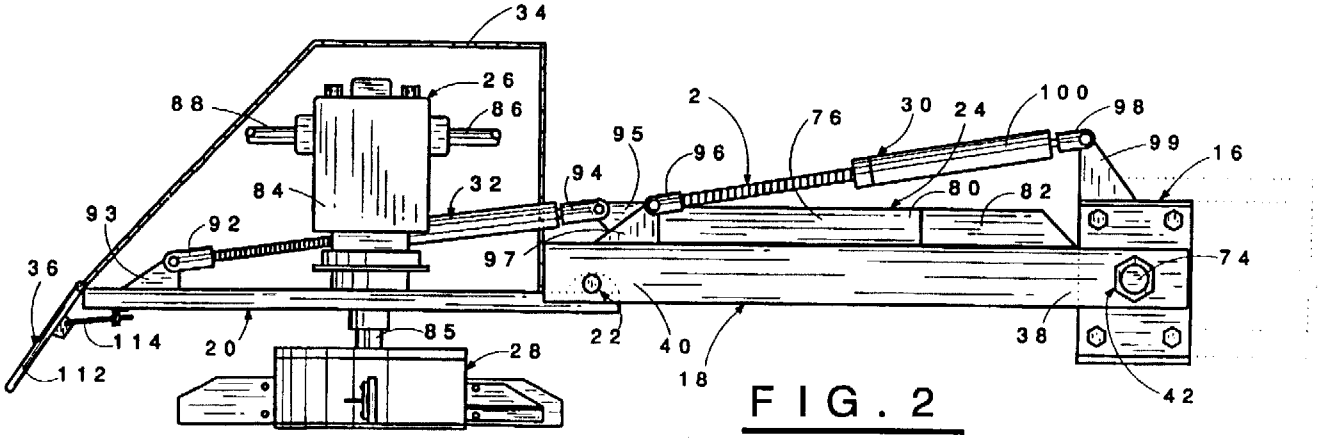
FIG. 2 is a partially sectionalized, lateral view of a first embodiment of a dirt distribution device of the invention.

Referring in detail to the drawings, the dirt distribution device 2 of the invention is designed for attachment to the earth moving blade 4 of a earth moving machine 6 comprising conventional wheels 8, control cab 10, motor unit 12 and blade adjustments means 14.

The device 2 basically comprises clamp means 16, an elongated arm 18, a quadrilateral platform 20, pivot means 22, prop means 24, motor means 26, dirt sling means 28, inboard adjustment means 30 and outboard adjustment means 32. Optionally, device 2 includes a motor cover 34 and dirt baffle 36.

The arm 18 is elongated along a longitudinal axis and has an inboard end section 38 and an outboard end section 40. It is pivotally mounted by end section 38 to the clamp means 16 by bolt means 42. Typically, arm 18 is formed of 4"×4"×⅜" square metal tubing and is 35.5" in length.

The quadrilateral platform 20 has an inboard end portion 44, an outboard end portion 46, a forward longitudinal side 48 and a rearward longitudinal side 50. Typically, the sides 48 and 50 are formed of 2"×4"×¼" rectangular tubing 29.5" long to which central plate 52 and cross webs 54A, 54B & 54C are welded.

The pivot means 22 comprises a shaft 56 defined by a forward segment 58 and a rearward segment 60 that extends through the outboard end section 40 of the arm 18.

Figures 3, 4, 8:
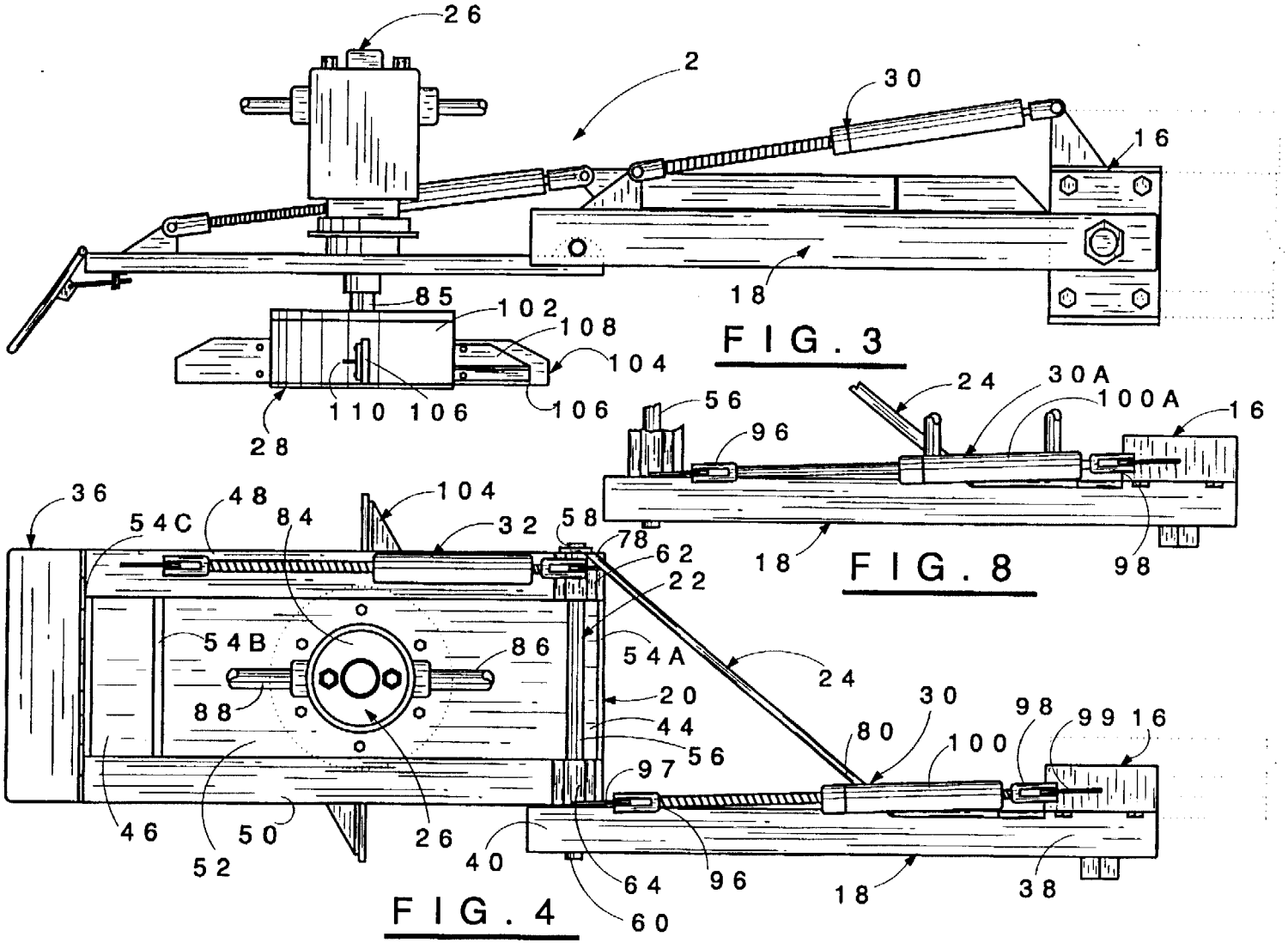
FIG. 3 is a front lateral view similar to FIG. 2 with a cover for the hydraulic motor portion of the device removed.
FIG. 4 is a plan view of the device shown in FIG. 3.
FIG. 8 is a fragmentary, lateral view of a second embodiment of the dirt distribution device of the invention.
Figures 9, 10, 11, 12, 13, 14, 15, 16:
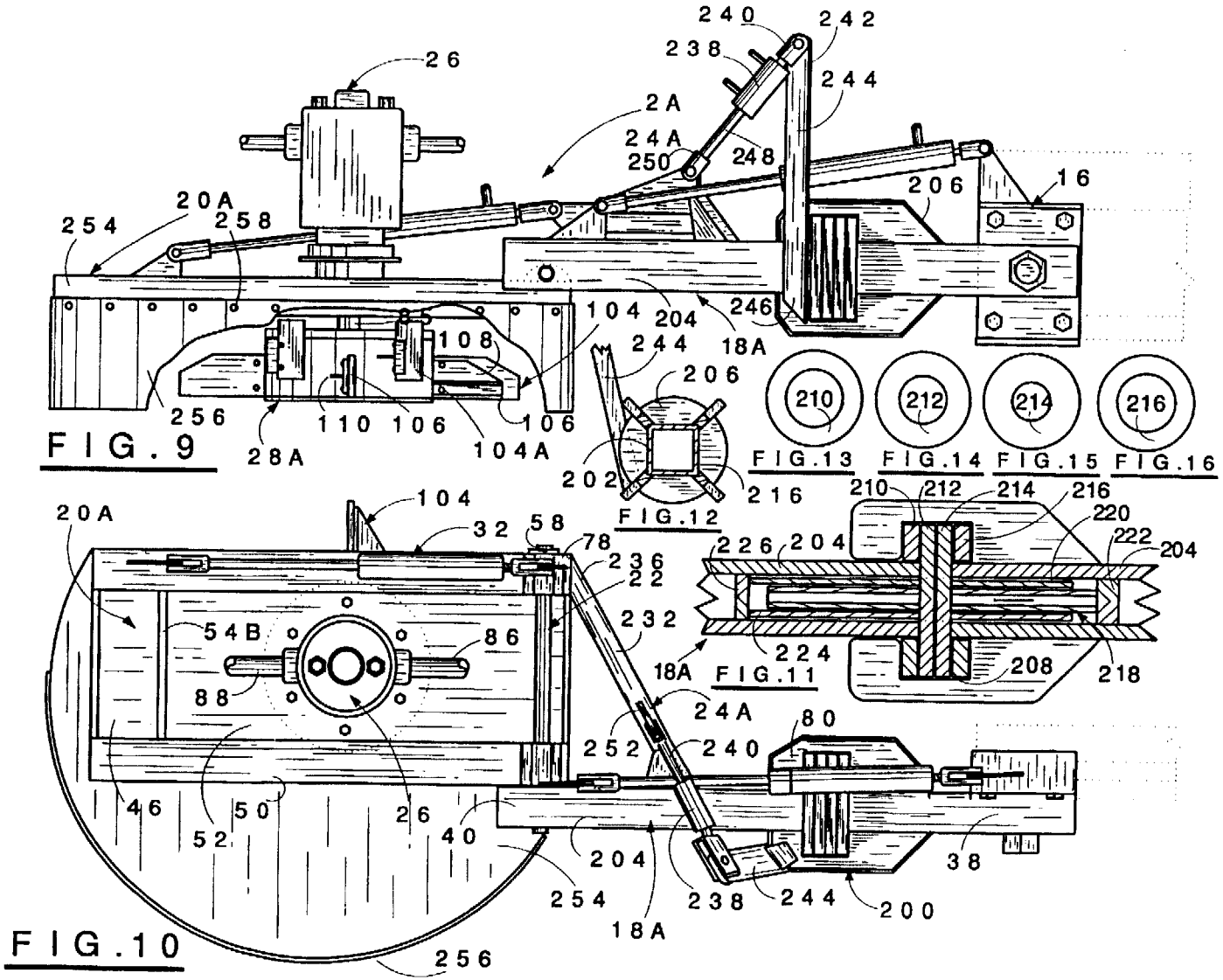
FIG. 9 is a lateral view of a third embodiment of a dirt distribution device of the invention.
FIG. 10 is a plan view of the third embodiment.
FIG. 11 is a fragmentary, sectional view taken on the line XI—XI of FIG. 9.
FIG. 12 is a fragmentary, sectional view taken on the line XII—XII of FIG. 10.
FIGS. 13–16 are plan views of discs comprising the axial rotation unit shown in FIGS. 9–11.

As best seen in FIG. 4, the inboard end portion 44 of platform 20 is mounted by journal units 62 & 64 upon shaft 56 for pivotal movement about an axis normal to the longitudinal axis of arm 18.

As shown in FIG. 7, the clamp means 16 comprises a U-shaped member formed of a quadrilateral base 66 and a pair of opposed jaws 68. Base 66 carries a plurality of bolts 70 threaded therein for engagement with a ledge portion (not detailed) of the earth moving blade 4 and a central bore 72 that receives bolt 74 of means 42 upon which the arm 18 is pivoted.

Prop means 24 comprises a elongated bar 76 having a first end 78 juxtaposed to the forward section 58 of shaft 56 and a second end 80 welded to the arm 18 and a brace bar 82. This prop means 24 serves to stabilize the position of the platform 20 and the position of the shaft 22 normal to the arm 18.

The motor means 26 advantageously comprises a hydraulic motor 84 including a drive shaft 85 upon which the dirt sling means 28 is carried for rotation in a plane below and parallel to the platform 20. Motor means 26 further includes conduits 86 & 88 for supply of pressurized hydraulic fluid to motor 84 from the motorized source 90 mounted on the bulldozer/grader machine 6 to provide torque sufficient to rotate the sling means at typically 1500 RPM.

The outboard adjustment 32 means includes a pair of opposed clevises, the clevis 92 being pivoted to a standard 93 fixed to the outboard end portion 48 of platform 20 and the clevis 94 is pivoted to a standard 95 fixed to the prop means 24. The outboard adjustment means typically comprises a turnbuckle or a hydraulic cylinder.

The inboard adjustment means 30 includes a pair of opposed clevises, the clevis 96 being pivoted to a standard 97 fixed to the outboard end section 40 of the arm 18 and the clevis 98 being pivoted to a standard 99 fixed to the clamp means 16. The inboard adjustment means 30 comprises a turnbuckle 100 (FIG. 4). An alternative form of adjustment means 30A (FIG. 8) comprises a hydraulic cylinder 100A.

The dirt sling means 28 comprises a drum unit 102 that carries a plurality of paddles 104 formed of a main web 106, a reinforcement web 108 and a transverse, support web 110.

The dirt baffle 36 includes a hinged plate 112 and a positioning screw adjuster unit 114.

In the typical use of the machine 6, as it travels along and its blade scrapes a ribbon of dirt (not shown) from the earth surface 116, such ribbon typically travels along the blade 4 toward a discharge end 4D and will be deposited closely adjacent the line of travel of the earth moving blade 4. With the new device of the invention 2 attached to machine 6, the dirt ribbon as it discharges from the end 4D of the grader blade 4 will be pulverized into small particles (not shown) and slung over an extended area considerably removed from the path of the moving machine 6. By manipulation of the inboard outboard adjustment means 30 and outboard adjustment means 32, the area of land and its distance from the machine travel path may be controlled.

The third embodiment of the dirt distribution device 2A shown in FIGS. 9–16 is basically similar to the first embodiment as described above, but comprises a modified arm 18A, a changed platform 20A, different prop means 24A and modified dirt sling means 28A.

A major change in device 2A from device 2 is the provision of the rotation unit 200 in the arm 18A. Thus, arm 18A is formed with an inboard member 202 and an outboard member 204 joined by rotation unit 200.

The unit 200 comprises four braces 206 welded to the four corners of the metal tubing of inboard arm member 202. The braces 206 contain slots 208 that envelope four discs 210, 212, 214 & 216 and form a cage for the discs.

Disc 210 is welded to the braces 206, disc 212 is welded to the inboard end 218 of the outboard arm member 204, disc 214 is welded to the outboard end 220 of the inboard arm member 202 and disc 216 is welded to the braces 206. Accordingly, arm member 204 and disc 212 are free to rotate about the longitudinal axis of the arm 18A relative to the arm member 202 and its attached support disc 214. The two discs 210 & 216 remain fixed with respect to the inboard arm member 202 and serve to stabilize the discs 212 & 214 and the outboard arm member 204.

The rotation unit 200 also comprises brace means 218 that comprises (a) an inner tube 220 fixed to a block 222 that is welded to the inside of arm member 202 and (b) an outer tube 224 fixed to a block 226 that is welded to the inside of arm member 204.

Another major change in device 2A from device 2 is in the prop means 24A. Unlike prop means 24 of device 2, the prop means 24A includes a third adjustment means 228.

The prop means 24A comprises a truncated brace 230 welded to arm member 204 and an elongated brace 232 welded at inboard end 234 to brace 230 and at outboard end 236 to the platform 20A.

Adjustment means 228 comprises a hydraulic piston 238 fixed by a clevis 240 to the upper end 242 of the elongated standard 244 which is welded at its lower end 246 to one of the braces 206 of rotation unit 200.

Adjustment means 228 further comprises a piston rod 248 fastened by clevis 250 to a standard 252 that is welded to the brace 232.

The construction of the adjustment means 228 as described permits the operation of the piston 238 to move the platform 20A and the outboard arm member 204 upon which the platform 20A is fixedly supported about the longitudinal axis of the inboard arm member 202. This gives an additional measure of control to the way in which the sling means 28A distributes earth upon the ambient ground.

The change in dirt sling means 28A for the first embodiment 28 involves the addition of upper staggered paddles 104A in addition to the lower paddles 104. These additional paddles provide increased control on the quality of pulverizing applied to the earth clumps cleaved by the earth mover blade.

The platform 20A of the device 2A is changed from platform 20 of device 2 primarily in the canopy arrangement for the sling means 28A. Thus, the platform 28A includes a cantilevered arcuate projection 254 from which an arcuate apron 256 is suspended by fasteners 258. The apron 256 can be made of a variety of materials, e.g., flexible, plastic or rubber impregnated fabric, sheet metal, etc.

The operation of device 2A is essentially like that of device 2, but, since the rotation unit 200 adds another axis of tilt to the platform 20A, device 2A enables a higher degree of control of (1) pulverization of earth clumps and (2) range and direction of distribution of the resulting dirt particles.

Figure 17:
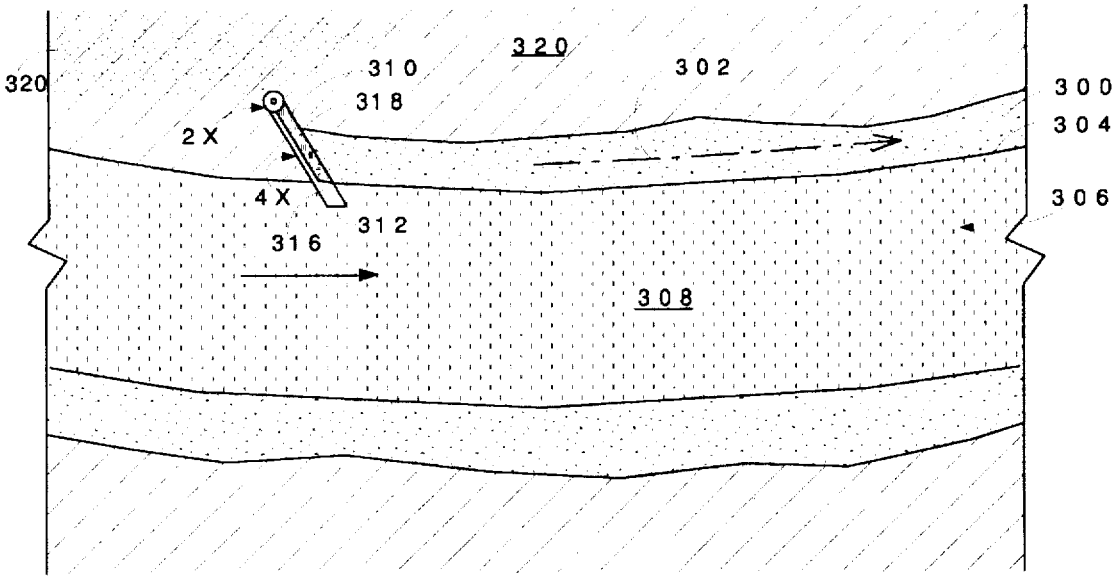
FIG. 17 is a diagrammatic plan view of a new method in accordance with the invention of removing a mound of earth from the side of a paved road.
Figure 18:
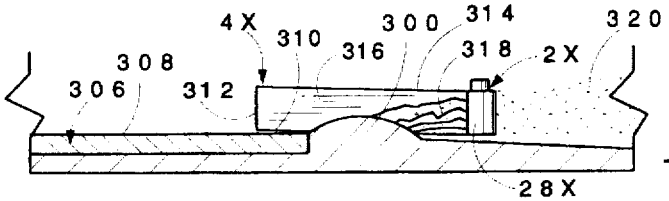
FIG. 18 is a fragmentary sectional view corresponding to FIG. 17 viewed from a position upstream of the point of removal of the roadside dirt mound.
Figure 19:
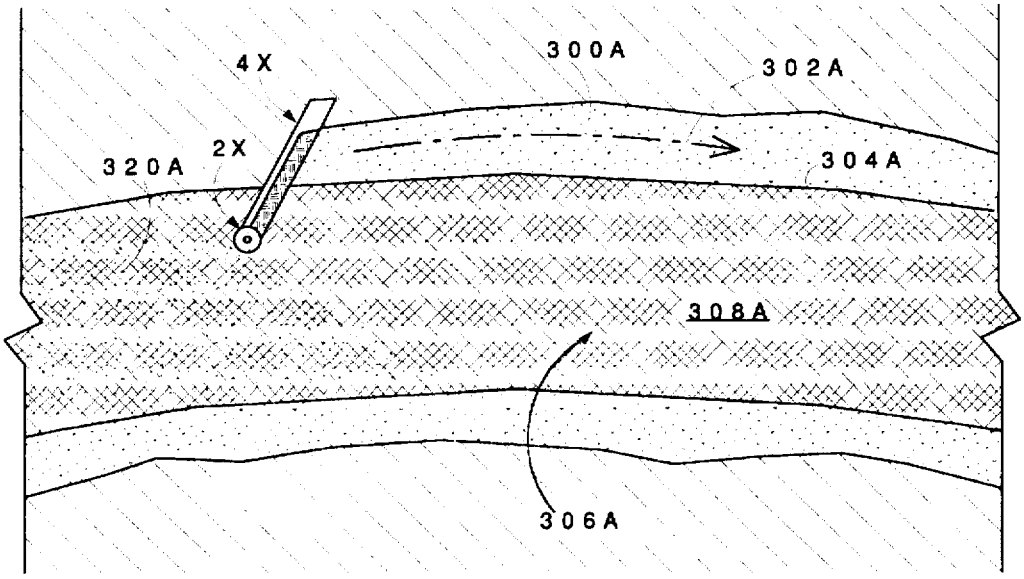
FIG. 19 is a diagrammatic plan view of a new method in accordance with the invention of removing a mound of earth from the side of a unpaved (dirt) road.

FIGS. 17–19 diagrammatically illustrate the new method of the invention for removing an elongated mound of earth from the side of a road in a manner that does not require the remove earth to be trucked away for disposal at some other location. For the sake of clarity, the tractor, road grader or like motor driven machine to which the earth moving blade is attached is not shown.

The new method of the invention enables removal of an elongated mound of earth 300, defined by a longitudnial axis 302, that borders the longitudnial edge 304 of a paved road 306 having a hard top surface 308 above which mound 300 projects.

As an initial step, one provides an earth moving blade 4X of the type of the invention defined by a lengthwise bottom edge 310, a forward side edge 312, a rearward side edge 314 and a front face 316 upstanding from the bottom edge 310 between the forward and rearward side edges. Also, one provides at the rearward side edge 314 a dirt distribution device 2X comprising dirt sling means 28X.

The blade 4X is positioned diagonally across the longitudnial axis 302 with its bottom edge 310 penetrating the mound 300 to sligthly above the top surface 308 of road 306.

To remove the mound 300, the blade 4X is moved forward, as indicated by the arrow in FIG. 17, along longitudinal axis 302 thereby to move the portion of the mound 300 immediately forward of front face 316 as a ribbon of earth 318 above bottom edge 310 and across face 316 toward rearward side edge 314. Simultaneously, one rotates the dirt distribution means 2X while allowing the earth ribbon 318 to contact means 2x thereby to disintegrate ribbon 318 into small pieces of earth 320 that are thrown away from means 2X and the road 306 onto the adjacent land 320.

FIGS. 17 & 18 illustrate use of the new method of the invention for removal of earth mounds from along side hard top, paved roads. FIG. 19 illustrates its use for removal of earth mounds from the side of unpaved roads surfaced with dirt, shale or like loose material.

In the case of the unpaved road 306A having a top surface 308A of loose dirt, the blade 4X is positioned across the earth mound 300A and its longitudinal axis 302A so that the dirt distribution means 2X is on the same side of the road edge 304A as the road 308A whereby particles of earth 320A generated by removal of mound 300A are distributed over the surface of the road 306A.

The new roadway mound and dirt distribution method of the invention provides great savings in manpower and money in roadway maintenance by highway departments and the like. By way of example, a typical crew used in edging a state or county road for periodic maintenance will comprise 9–11 people, a front end loader and a truck to remove earth, in addition the grader or like earth moving machine and such a crew will handle only about ½ to one mile of road per day. In contrast, standard quality roadway maintenance in accordance with the present invention can handle up to 15 miles of road per day with a crew of only 2 persons.

I claim:

1. A method of removing an elongated mound of earth, defined by a longitudinal axis bordering the longitudinal edge of a road having an top surface above which said mound projects, without need to truck away quantities of accumulated removed earth, which comprises in combination the steps of:

providing a bulldozer/grader machine comprising:

an earth moving blade defined by a lengthwise bottom edge, a forward side edge, a rearward side edge and a front face upstanding from said bottom edge between said forward and rearward side edges and having attached thereon by clamp means a dirt distribution device comprising:

an elongated arm defined by a longitudinal axis, an inboard end section and an outboard end section, said arm being pivotally mounted by said inboard end section to said clamp means, a platform defined by an inboard end portion, an outboard end portion, a forward side and a rearward side, pivot means comprising a shaft defined by a forward segment and a rearward segment mounting said platform by said inboard end portion upon said outboard end section of said arm for pivotal movement of said platform about an axis normal to said longitudinal axis, prop means to brace said pivot means relative to said arm, motor means carried upon said platform, dirt sling means rotatably carried by said motor means, inboard adjustment means to vary the radial position of said arm relative to said clamp means, and outboard adjustment means to vary the radial position of said platform relative to said arm, positioning said earth moving blade diagonally across said longitudinal axis with said lower edge penetrating said mound to slightly above said top surface of said road, moving said blade forward along said longitudinal axis thereby to move portions of said mound immediately in front of said front face across said front face toward said rearward side edge as a continuous ribbon of said earth to thereby bring said ribbon of said earth into contact with said dirt sling means, and rotating said dirt sling means thereby to disintegrate said ribbon into small pieces of earth that are thrown away from said rearward side edge.

2. The method of claim 1 wherein said top surface of said road is macadam, said rearward side edge of said blade is on the side of said mound opposite to said road and said small pieces of earth are thrown away from said road.

3. The method of claim 1 wherein said top surface of said road is dirt, said rearward side edge of said blade is on the same side of said mound as said road and said small pieces of earth are thrown onto said road.

* * * * *